US006357422B1

(12) United States Patent
Doane et al.

(10) Patent No.: US 6,357,422 B1
(45) Date of Patent: Mar. 19, 2002

(54) FUEL PRESSURE REGULATION SYSTEM

(75) Inventors: Kirk D. Doane, Essexville; John D. Zmierski, Cass City, both of MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/579,571

(22) Filed: May 26, 2000

(51) Int. Cl.[7] ..... F02M 41/00
(52) U.S. Cl. ..... 123/458; 123/533
(58) Field of Search ..... 123/458, 462, 123/457, 531, 533

(56) References Cited

U.S. PATENT DOCUMENTS

| | | | | |
|---|---|---|---|---|
| 4,693,224 A | | 9/1987 | McKay | 123/531 |
| 4,825,828 A | | 5/1989 | Schlunke et al. | 123/276 |
| 4,981,127 A | * | 1/1991 | Morikawa | 123/494 |
| 5,024,201 A | * | 6/1991 | Kobayashi et al. | 123/531 |
| 5,150,692 A | * | 9/1992 | Trombley et al. | 123/533 |
| 5,289,812 A | * | 3/1994 | Trombley et al. | 123/533 |
| 5,409,169 A | * | 4/1995 | Saikalis et al. | 239/404 |

* cited by examiner

*Primary Examiner*—Henry C. Yuen
*Assistant Examiner*—Mahmoud Gimie
(74) *Attorney, Agent, or Firm*—Reising, Ethington, Barnes, Kisselle, Learman & McCulloch, PC

(57) ABSTRACT

A fuel pressure regulation system for use in a fuel pump system in which atomizing air is injected into the fuel delivered to the injector. The system includes both an air rail and a fuel rail and is operable to maintain the fuel pressure within the system at a consistent pressure above the air rail pressure. The system also includes a first pressure sensor, a second pressure sensor, a control circuit, and a fuel pressure pump or other fuel control device. The first and second pressure sensors are differential pressure sensors which measure the air and fuel pressure, respectively, convert those measurements into first and second electronic signals, and send those signals to the control circuit. The control circuit is an electronic circuit that includes a first stage, a second stage, and an output stage and provides the fuel pump with closed loop control based on the first and second signals. Preferably, the closed loop control is achieved using both proportional and integral control with the output being in the form of a pulse-width modulated signal. The fuel pump is in fluid communication with the fuel rail and adjusts the fluid pressure within the fuel rail according to the pulse-width insulated signal sent by the control circuit.

21 Claims, 2 Drawing Sheets

FUEL PRESSURE REGULATION SYSTEM

FIELD OF THE INVENTION

This invention relates generally to a fuel delivery system and more particularly to a fuel pressure regulation system for a marine engine.

BACKGROUND OF THE INVENTION

Electric motor fuel pumps have been used in various ways to deliver fuel to internal combustion engines for a wide range of applications. One such use of electric fuel pumps is in the form of a constant-delivery fuel pump, in which the electric fuel pump is operated at a constant speed with a pressure regulator being used to return excess fuel from the engine to the fuel tank. It should be noted that there are many disadvantages associated with a fuel pump system of this kind. For instance, the returned or excess fuel carries engine heat with it to the fuel tank, thereby increasing the temperature and vapor pressure within the tank. Venting this vapor pressure into the atmosphere causes pollution problems and adversely affects fuel mileage. Additionally, operating the motor at a constant high speed increases energy consumption and reduces the operational life of the fuel pump, fuel filter, and other components.

Another type of fuel pump system uses a feedback loop to control the speed of the fuel pump, the duration of operation, or other operational parameters. Unlike the constant speed excess return pumps previously described, a fuel pump system which incorporates a feedback loop will drive the fuel pump according to the output which is required. U.S. Pat. No. 4,728,264 discloses a fuel delivery system in which a D.C. motor fuel pump delivers fuel under pressure from a fuel tank to the engine. A pressure sensitive switch is responsive to fuel pump output pressure for applying a pulse-width modulated D.C. signal to the pump motor, and thereby controlling pump operation so as to maintain constant pressure in the fuel delivery line to the engine independently of fuel demand. Similarly, U.S. Pat. No. 4,789,308 discloses a self-contained fuel pump that includes an electronic sensor in the pump outlet end cap responsive to fuel outlet pressure for modulating application of current to the pump motor and maintaining a constant pressure in the fuel delivery line. Although the aforementioned fuel delivery systems address and overcome a number of problems present in the art, further improvements are continually being made. For instance, the addition of air to combustible fuel delivered to an injector has proven effective in increasing the atomization of the injected fuel and thus, the quality of the combustion in the cylinder.

An example of this type of direct air-fuel injection system is seen in U.S. Pat. No. 4,693,224 and U.S. Pat. No. 4,825,828. In the fuel delivery systems disclosed in these patents, air is entrained within a premetered quantity of fuel and the mixture is delivered directly to a combustion chamber via the injector. Consequently, a system such as this requires both a fuel rail and air rail and components for introducing elements of those two rails together in some premetered fashion. In this regard, it should be noted that there are certain disadvantages which arise when the pressures maintained in the air and fuel rails are not related to each other, particularly when one of the rails experiences a sudden fluctuation not experienced in the other rail. These conditions may result in an undesirable ratio of fuel and air being supplied to the injector.

Thus, it would be advantageous to provide a fuel delivery system which supplies atomizing air into the fuel in a manner that maintains accurate control of the relative amounts of air and fuel mixed together.

SUMMARY OF THE INVENTION

The above-noted shortcomings of prior art fuel delivery systems are overcome by the present invention which provides a fuel pressure regulation system for applications such as those noted above in which improved combustion is achieved by supplying an injector with atomizing air entrained with a premetered amount of fuel. The fuel pressure regulation system of the present invention mixes the air with the fuel based on relative pressures within the air and fuel rails, and comprises a first pressure sensor, a second pressure sensor, a control circuit, and a fuel pump or some other pressure control device. The first pressure sensor measures the air pressure within an air rail, converts the measured air pressure into an electronic signal, and sends this air pressure signal to the control circuit. Similarly, the second pressure sensor measures the fluid pressure within a fuel rail, converts the measured fluid pressure into an electronic signal, and sends this fuel pressure signal to the control circuit. The control circuit is an electronic circuit that generally includes a first stage, a second stage, and an output stage and provides the fuel pump with closed loop control which maintains the fuel rail at a fixed pressure relative to the air rail. Preferably, the control circuit provides closed loop control which entails both proportional and integral control using a pulse-width modulated signal to drive the fuel pump. The fuel pump is in fluid communication with the fuel rail and is operable to adjust the fluid pressure within the fuel rail according to the pulse-width modulated signal sent by the control circuit.

Objects, features and advantages of this invention include providing a fuel pressure regulation system which maintains the fuel rail pressure at a constant pressure relative to the air rail pressure, provides closed-loop control of the fuel pump, supplies a constant air and fuel mixture to an injector, and is of relatively simple design, economical manufacture and assembly and has a long and useful life in service.

DETAILED DESCRIPTION OF THE PREFERRED EMBODIMENTS

Figure 1:
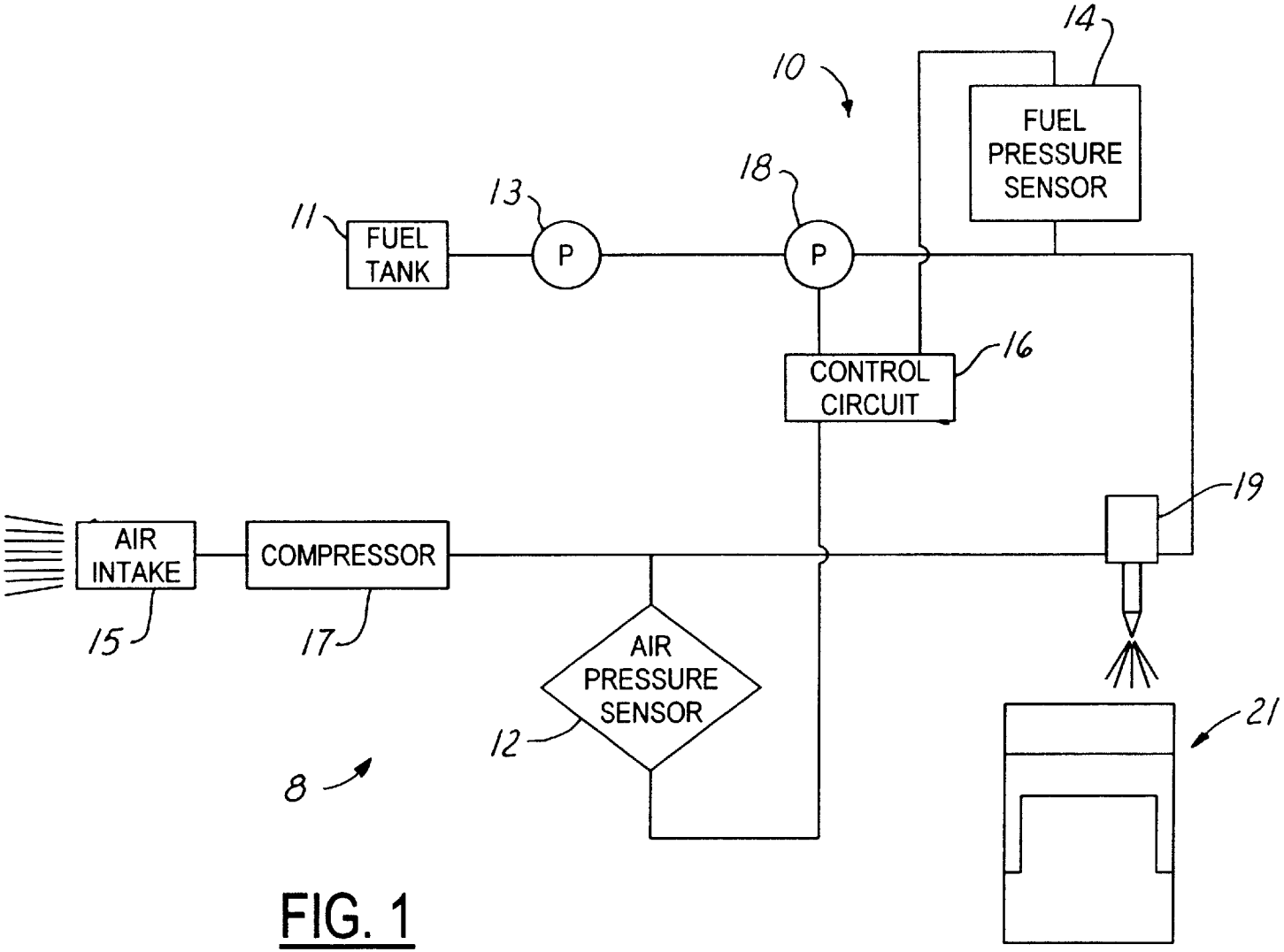
FIG. 1 is a block diagram of a preferred embodiment of a fuel delivery system of the present invention as it would be used for an internal combustion engine.

With reference to FIG. 1, there is shown a fuel delivery system 8 which delivers fuel and air to an internal combustion engine and generally includes a fuel pressure regulation system 10, a fuel tank 11, a delivery pump 13, an air intake 15, an air compressor 17, an injector 19, and a cylinder assembly 21. Delivery pump 13 is a low pressure fuel pump which draws fuel from fuel tank 11 and delivers the fuel under a low pressure, typically 10 p.s.i., to the fuel pressure regulation system 10. The fuel pressure regulation system includes a high pressure fuel pump 18 which receives fuel from the delivery pump and supplies an injector 19 with pressurized fuel maintained at a certain pressure relative to a system air pressure, as will be subsequently explained. Air compressor 17 draws air from an external source through air intake 15 and delivers the air under a moderate pressure, typically 80 p.s.i., to injector 19. Consequently, injector 19 receives both pressurized fuel and air which are mixed in the injector before being delivered to a combustion chamber of the cylinder assembly 21. Methods for mixing the pressurized fuel and air are disclosed in U.S. Pat. No. 4,693,224 and 4,825,828, the entire contents of which are incorporated herein by reference.

Figure 2:
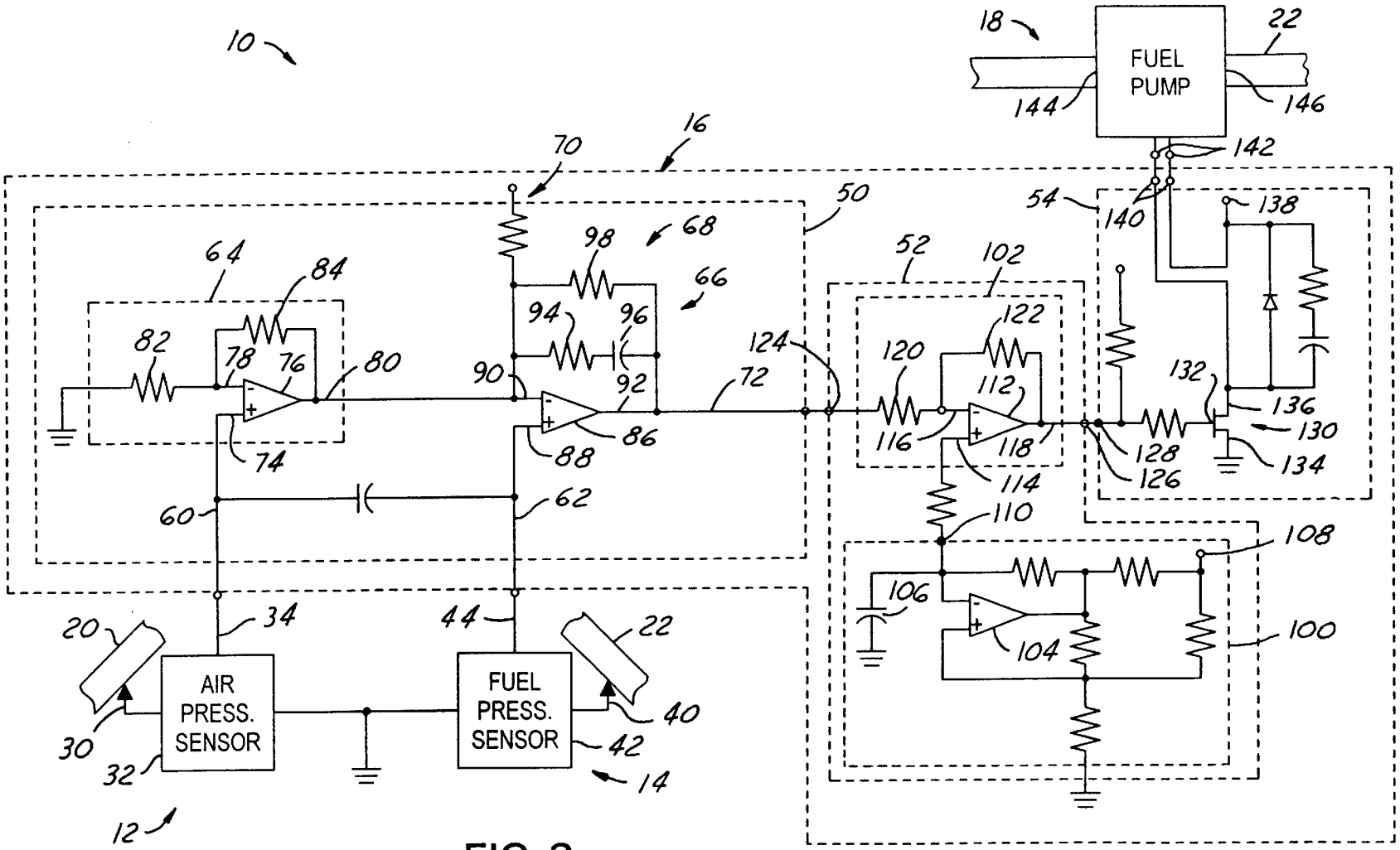
FIG. 2 is a schematic view of a fuel pressure regulation system used in the fuel delivery system of FIG. 1.

With reference to FIG. 2, the fuel pressure regulation system 10 is shown in greater detail and, in general, includes a first pressure sensor 12, a second pressure sensor 14, a control circuit 16, and a fuel pump or other fuel pressure control device 18. First pressure sensor 12 is an air pressure sensor which measures the air pressure within an air rail 20, converts the measured air pressure into a first electronic signal, and sends this first signal to control circuit 16. Second pressure sensor 14 is a fuel pressure sensor which, similarly, measures the fluid pressure within a fuel rail 22, converts the measured fluid pressure into a second electronic signal, and sends this second signal to the control circuit. Control circuit 16 is an electronic circuit that generally includes a first stage 50, a second stage 52, and an output stage 54. The control circuit receives the aforementioned signals from sensors 12, 14, processes those signals, and drives the fuel pump 18 such that the fluid pressure within the fuel rail is maintained at a fixed pressure above the air pressure within the air rail. Thus, fuel pump 18 is in fluid communication with the fuel rail and adjusts the fluid pressure within the fuel rail according to a third signal outputted by the control circuit.

Air pressure sensor 12 can be a conventional sensor that includes an air sensor tip 30, an air pressure converter 32, and an air pressure output 34. Air pressure sensor 12 is preferably a differential pressure sensor which, as commonly known in the art, compares the difference between a measured pressure with some reference pressure, such as normal atmospheric pressure. Consequently, the signal generated by this pressure sensor is not representative of an absolute air pressure value, but rather the difference between that absolute pressure and some known pressure. Air sensor tip 30 is in physical communication with air rail 20 at one end and connected to the air pressure converter at the other. The air sensor tip measures the pressure within the rail and the air pressure converter 32 converts that measurement into an electric signal indicative of the air pressure. Air pressure converter 32 is connected to both air sensor tip 30 and air pressure output 34, which is used to transmit the air pressure signal from the air pressure sensor 12 to control circuit 16.

Fuel pressure sensor 14 is similar in design and operation to the air pressure sensor previously described, except this pressure sensor measures the fluid pressure within fuel rail 22, as opposed to the air pressure within air rail 20. Fuel pressure sensor 14 is a fluid pressure sensor generally comprised of a fuel sensor tip 40, a fuel pressure converter 42, and a fuel pressure output 44, and is preferably a differential pressure sensor. Consequently, the signal generated by this pressure sensor is not representative of an absolute fuel pressure value, but rather the difference between that absolute pressure and some reference pressure, particularly the same reference pressure used to generate the air pressure signal. Fuel sensor tip 40 is in fluid communication with fuel rail 22 at one end and connected to the fuel pressure converter at the other, such that the fuel sensor tip measures the fluid pressure within the rail and the fuel pressure converter 42 converts that measurement into an electric signal indicative of the fuel pressure. Fuel pressure converter 42 is also connected to fuel pressure output 44, consequently, the converted fuel pressure signal is sent to control circuit 16 via fuel pressure output 44. It should be noted that a comparison of the first and second signals generated by the differential pressure sensors is, in essence, a comparison of their absolute pressures since they are both related to the same reference pressure.

Control circuit 16 is an electrical circuit which receives and processes the aforementioned air and fuel pressure signals, modulates the processed signals, and drives the fuel pump 18 such that fluid pressure within the fuel rail is maintained at a fixed pressure relative to the air pressure within the air rail. First stage 50 receives signals from the air and fuel pressure sensors and provides a closed loop control signal to the second stage 52. The second stage utilizes the control signal outputted from the first stage to provide a pulse width modulated signal to the output stage 54, which drives the fuel pump 18 accordingly.

First stage 50 generally includes an air pressure input 60, fuel pressure input 62, amplifier 64, integrator 66, differentiator 68, reference voltage source 70, and first stage output 72. Air pressure input 60 is connected between air pressure output 34 at one end and amplifier 64 at the other end. Amplifier 64 buffers the air pressure signal and includes an operational amplifier (op-amp) 76 having a non-inverting input 74, an inverting input 78, and an op-amp output 80, resistor 82, and resistor 84. The non-inverting input 74 is connected to air pressure input 60 and therefore sees a signal representative of the air pressure. The inverting input 78 is coupled to ground via resistor 82 and to op-amp output 80 via resistor 84, thereby creating a negative feedback which amplifies the non-inverted input signal by a gain set by resistors 82 and 84.

Fuel pressure input 62 is connected between fuel pressure output 44 at one end and an input to both integrator 66 and differentiator 68 at the other end. Integrator 66 and differentiator 68 both share op-amp 86 and each provides a different type of closed loop control, the combination of which is sent to the second stage for modulation. Op-amp 86 has a non-inverting input 88, an inverting input 90, an op-amp output 92, and operates as commonly known in the art. The non-inverting input 88 is connected to the fuel pressure input 62 and therefore sees a signal representative of the fuel pressure. Inverting input 90 is connected to op-amp output 80 and reference voltage source 70 as well as being coupled to op-amp output 92 via two parallel paths. The first parallel path is a portion of integrator 66 and includes the series connection of resistor 94 and capacitor 96. The second parallel path includes a single resistor 98 which is a component of differentiator 68. The reference voltage source provides the inverting input 90 with a certain DC voltage bias, which is related to the desired fixed pressure difference between the rails. Op-amp output 92 is connected to first stage output 72, which connects to the second stage. Thus, the first stage provides the second stage with an output that is dependent upon the sum of the reference voltage and the difference between the air and fuel pressure signals.

Second stage 52 generally includes a periodic waveform generator 100, comparator 102, second stage input 124 and second stage output 126. Periodic waveform generator 100 provides a periodic signal, and includes an op-amp 104, a capacitor 106, multiple resistors, a voltage source 108, and a waveform output 110. This particular periodic waveform generator produces a periodic signal through the charging and discharging of capacitor 106. However, it should be noted that there are many other suitable ways to produce a periodic signal, as are commonly known in the art. Waveform output 110 is coupled to comparator 102 via a resistor, and therefore provides the comparator with a periodic input. Comparator 102 also receives a signal from the first stage and produces a pulse-width modulated output based on these two input signals. The comparator includes an op-amp 112 having a non-inverting input 114, an inverting input 116, and an op-amp output 118, and resistors 120 and 122. The inverting input 116 is coupled to second stage input 124 via resistor 120 and to op-amp output 118 via resistor 122. Op-amp output 118 is connected to second stage output 126.

Output stage 54 generally includes output stage input 128, transistor 130, power source 138, and terminals 140. Output stage input 128 is connected to second stage output 126 at one end and coupled to transistor 130 at the other end. Transistor 130 is preferably a MOSFET transistor, as is commonly known in the art, and includes a gate terminal 132, a source terminal 134, and a drain terminal 136. Gate terminal 132 draws a negligible amount of current; consequently, the signal sent from second stage output 126 will not experience a significant voltage drop when coupled to gate 132 and will essentially determine what state the transistor is in. The source terminal 134 of the transistor is connected to ground, while the drain terminal 136 is connected to one of two terminals 140. Power source 138 is connected to the other of two terminals 140 and therefore may establish a conductive path from the power source to ground, via fuel pump 18 and transistor 130. Thus, fuel pump 18 is operated in accordance with the pulse-width modulated signal outputted from second stage 52 which controls the state of transistor 130.

Fuel pump 18 regulates the fluid pressure within fuel rail 22 based on an input signal produced by control circuit 16. Fuel pump 18 generally includes power inputs 142, a fuel inlet 144, and an outlet 146. Power inputs 142 are connected to terminals 140. The fuel pump is mechanically coupled to the pump outlet 146, which is in fluid communication with the interior of the fuel rail 22. Operation of the fuel pump motor draws fuel into the inlet 144 and applies pressure to the fluid within the fuel rail, thereby increasing the fluid pressure as measured by second pressure sensor 14.

In operation, first pressure sensor 12 measures the air pressure within air rail 20, converts the measured pressure into an electronic signal, and transmits the signal to control circuit 16. Firstly, air sensor tip 30, which is in physical communication with the interior of air rail 20, takes an air pressure reading within the air rail. The air sensor tip is coupled to air pressure converter 32 which converts the air pressure reading to a first electronic signal indicative of the measured air pressure relative to some fixed pressure. This first signal is sent to air pressure input 60 of the control circuit via air pressure output 34.

Concurrent with the air pressure reading, fuel pressure sensor 14 measures the fluid pressure within fuel rail 22. Fuel sensor tip 40, which is in fluid communication with the interior of fuel rail 22, takes a fluid pressure reading of the rail. The fuel sensor tip is coupled to fuel pressure converter 42 which converts the pressure reading to an electronic signal. This fuel pressure signal is indicative of the measured fuel pressure relative to the same fixed pressure value used to determine the air pressure and is subsequently sent to fuel pressure input 62 of the control circuit via fuel pressure output 44. Accordingly, control circuit 16 receives the air and fuel pressure signals, which represent the difference in the measured air and fuel pressure, respectively, relative to a common fixed pressure.

First stage 50 of the control circuit receives the air and fuel pressure signals and provides closed loop control to fuel pump 18 according to the difference between the first and second signals. The air pressure signal outputted from the air pressure sensor 12 is sent to the non-inverting input 74 of amplifier 64. The amplifier 64 is a circuit in which a signal is supplied to a non-inverting input having a very high input impedance and the output is a non-inverted amplification of the input signal based on the transfer function:

$$V_0 = V_i\left[\frac{R_o}{R_i} + 1\right]$$

In the preferred embodiment of the present invention, it is not the intention to greatly amplify the input signal, rather to buffer this signal (air pressure measurement) or prevent potentially damaging current from flowing into the air pressure sensor 12. The resistor $R_o$ corresponds to resistor 84, while resistor $R_i$ corresponds to resistor 82. Using the values $R_0$=1 kΩ and $R_i$=1 MΩ, there is virtually no amplification of the input signal, as the gain is nominal.

$$V_0 = V_i\left[\frac{1\times10^3}{1\times10^6}\right] \approx V_i$$

Hence, the signal sent from air pressure sensor 12 is essentially the same signal seen at the inverting input 90.

Fuel pressure input 62 connects fuel pressure signal generated by the fuel pressure sensor 14 to the non-inverting input 88 of op-amp 86. Op-amp 86 is an integral component to both the integrator circuit 66 and the differentiator circuit 68, which have feedback loops connected in parallel. The signal seen at inverting input 90 is affected by several components, including op-amp output 80, reference voltage source 70, and resistors 94 and 98. As previously mentioned, portions of integrator 66 and differentiator 68 are connected in parallel and each contributes a particular component to the output, the combination of which is seen at op-amp output 92. Because capacitor 96 of integrator 66 is a non-linear device, integrator 66 produces a non-linear component of the total output seen at op-amp output 92. This component is related to the integral of the difference between the input signals as a function of time. Accordingly, if the difference between inputs 88 and 90 remained constant, the integral of that difference, as a function of time, would be increasing. Differentiator 68 includes a single resistor 98 connected across inverting input 90 and op-amp output 92 and produces an output which is linearly proportional to the difference between the two inputs. Hence, a constant difference between inputs 88 and 90 would not produce an increasing output, as seen with the integrator, but produces a constant output based on that difference. Reference voltage source 70 provides a certain DC bias to the inverting input 90, which is summed with all of the signals converging at that node, and is adjustable according to a variable resistor. Through their feedback loops, both the integrator 66 and the differentiator 68 attempt to maintain inputs 88 and 90 at an equal voltage. Introduction of the reference voltage source allows the system to maintain inputs 88 and 90 at an approximately equal value, even though the pressures in the air and fuel rails are unequal. Accordingly, adjustment of the reference voltage source controls the higher fixed pressure value at which the system strives to maintain the fuel rail relative to the air rail. Op-amp output 92 sends the resultant output signal of the first stage to the second stage.

Second stage 52 receives both the closed loop control signal generated by the first stage and a periodic signal sent from the periodic waveform generator 100. Operation of the second stage 52 is as follows. If first stage 50 receives a signal which indicates a low fuel pressure and therefore needs to increase the duty cycle of the fuel pump 18, the signal on the non-inverting input 88 will likely be lower than that signal on inverting input 90 and produce a more negative first stage output. This output is received on the inverting input 116 of the op-amp 112 and the periodic waveform signal is received on the non-inverting input 114. Assuming the periodic waveform generator produces a periodic signal that rises from zero, the non-inverting input 114 (waveform signal) will spend a majority of the time at a higher value than the inverting input 116 (first stage signal), and will thereby produce a pulse-width modulated signal having a high duty cycle. Conversely, a high fuel pressure will present the inverting input 116 with a more positive signal, which spends a majority of the time at a higher value than the waveform signal at the non-inverting input 114, thereby producing a pulse-width modulated signal with a low duty cycle. The signal produced by op-amp 112 is connected to the output stage input 128 and determines when power is supplied to the fuel pump 18.

The output stage 54 drives the fuel pump 18 with power from power source 138 and which is controlled by the outputted signal of the second stage. Output stage input 128 is coupled to gate 132 of transistor 130 and thereby controls the conductive state of the transistor. The source 134 is connected to ground while the drain 136 is connected to one of two output stage terminals 140, the other output stage terminal is connected to power source 138. Each output stage terminal 140 is connected to a complimentary power input terminal 142 on the fuel pump. Accordingly, a potentially conductive channel from power source 138 to ground is created via fuel pump 18 and transistor 130. When the signal being sent from the second stage 50 to gate 132 is sufficient to overcome the turn-on voltage of the transistor (i.e., during "on" periods of the pulse-width modulated drive signal), the channel across the drain and source becomes conductive. Hence, the current needed to operate the fuel pump flows through that device, thereby turning on fuel pump 18 and increasing the fluid pressure within the fuel rail 22.

There are at least two pressure scenarios which may arise, each of which affects the overall system in a different manner. In a first scenario, there is a high air pressure within air rail 20 and a low fluid pressure within fuel rail 22. In general, control circuit 16 will increase the power to fuel pump 18, which will turn on fuel pump 144 and thereby increase the fluid pressure within the fuel rail 22 and minimize the inequality of pressure between the two rails. Initially, the air and fuel pressure sensors 12, 14 measure the air and fuel rails 20, 22, respectively, and send signals to the air and fuel pressure inputs 60, 62, respectively. The air pressure signal passes through the amplifier 64 essentially unamplified and thereafter appears at the inverting input 90 of op-amp 86, in combination with the DC bias supplied by reference voltage source 70. The fuel pressure signal is connected directly to the non-inverting input 88 of op-amp 86. Consequently, when there is a high air pressure reading and a low fuel pressure reading, the inverting-input will be at a higher voltage than the non-inverting input 88, thereby causing op-amp output 92 to send a signal which is more negative and proportional to the disparity between the two inputs. This signal is coupled to the inverting input 116 of second stage 52 while the non-inverting input receives a periodic signal from the waveform generator 100, preferably a sawtooth wave or the like. In this situation, the non-inverting input spends a majority of the time at a higher voltage than the inverting input and therefore produces a high duty cycle signal at op-amp output 118, as is commonly known in systems utilizing-pulse width modulation. It should be noted that the lower the signal outputted from the first stage, the more time the non-inverting input will be at a higher value than the inverting input and the higher the duty cycle of the signal sent to the output stage 54. Op-amp output 118 is coupled to gate 132 and will turn on transistor 130 as long as the output signal from the second stage is greater than the turn-on voltage. Once the transistor is conductive, the fuel pump is powered with current which increases the pressure in the fuel rail, thereby increasing the fuel pressure reading and hence the signal seen at the non-inverting input 88 of the first stage. As this non-inverting input rises, the difference between the two inputs decreases and thereby decreases the absolute value of the signal seen at op-amp output 92. A signal becoming more positive is seen at inverting input 116, which translates into less time when the non-inverting input 114 is at a higher value than the inverting input. Consequently, the signal seen at op-amp output 118 has a decreasing duty cycle and the fuel pump is supplied with less power accordingly.

In the second scenario, there is a low air pressure within air rail 20 and a high fluid pressure within fuel rail 22. Overall, control circuit 16 will decrease the amount of time power is sent to the fuel pump 18, which decreases the fluid pressure within the fuel rail. In the present scenario, a low air pressure reading and a high fuel pressure reading will drive the non-inverting input 88 to a voltage which is higher than the inverting input 90, thereby causing op-amp output 92 to have a positive signal which is proportional to the difference between the two inputs. This positive signal is coupled to the inverting input 116 of second stage 52 while non-inverting input 114 receives a periodic signal from periodic waveform generator 100. In this situation, the non-inverting input spends a majority of the time at a voltage lower than the inverting input, thereby producing a zero or other low duty cycle pulse-width modulated signal. Accordingly, the pump will stay off or run at this low duty cycle until the fuel pressure drops down to the defined pressure which is relative to that in the air rail.

It will thus be apparent that there has been provided in accordance with the present invention a fuel pressure regulation system for use in a combustion engine which achieves the aims and advantages specified herein. It will of course be understood that the foregoing description is of a preferred exemplary embodiment of the invention and that the invention is not limited to the specific embodiment shown. Various changes and modifications will become apparent to those skilled in the art and all such variations and modifications are intended to come within the spirit and scope of the appended claims.

What is claimed is:

1. A fuel pressure regulation system for use with an internal combustion engine, comprising:

a first pressure sensor having an output which provides a first signal representative of an air pressure, a second pressure sensor having an output which provides a second signal representative of a fuel pressure, a control circuit having a first input which is coupled to said output of said first pressure sensor to thereby receive said first signal, a second input which is coupled to said output of said second pressure sensor to thereby receive said second signal, and an output which provides a third signal which is determined using said first and second signals, and a fuel pressure control device having an input which is coupled to said output of said control circuit to thereby receive said third signal, wherein said fuel pressure control device utilizes said third signal to adjust the fuel pressure such that the fuel pressure is maintained at a level relative to the air pressure.

2. A fuel pressure regulation system as defined in claim 1, further comprising a fuel rail with said second pressure sensor being coupled to said fuel rail to produce said second signal as a fuel pressure signal representative of the fuel pressure in said fuel rail.

3. A fuel pressure regulation system as defined in claim 2, further comprising an air rail that provides atomizing air for mixing with fuel from said fuel rail, said first pressure sensor being coupled to said air rail to produce said first signal as an air pressure signal representative of the air pressure in said air rail.

4. A fuel pressure regulation system as defined in claim 1, wherein at least one of said first and second pressure sensors are differential pressure sensors.

5. A fuel pressure regulation system for use with an internal combustion engine, comprising:

a first pressure sensor having an output which provides a first signal representative of an air pressure, a second pressure sensor having an output which provides a second signal representative of a fuel pressure, a control circuit having a first input coupled to said output of said first pressure sensor to thereby receive said first signal, a second input coupled to said output of said second pressure sensor to thereby receive said second signal, an output which provides a third signal which is determined using said first and second signals, and a first stage having a first input coupled to said first input of said control circuit, a second input coupled to said second input of said control circuit, and an output coupled to said output of said control circuit, said first stage provides closed loop control of the fuel pressure at a level determined using said first signal, and a fuel pressure control device having an input coupled to said output of said control circuit to thereby receive said third signal, wherein said fuel pressure control device adjusts the fuel pressure in accordance with said third signal of said control circuit.

6. A fuel pressure regulation system as defined in claim 5, wherein said first stage is operable to control the fuel pressure via said fuel pressure control device to maintain the fuel pressure at a fixed level relative to the air pressure.

7. A fuel pressure regulation system as defined in claim 5, wherein said first stage provides proportional control of the fuel pressure.

8. A fuel pressure regulation system as defined in claim 7, wherein said first stage also provides integral control of the fuel pressure .

9. A fuel pressure regulation system as defined in claim 5, wherein said first stage includes a reference voltage source having an output which is coupled to one of said two inputs of said first stage, whereby said first stage provides closed loop control of the fuel pressure at a level determined using said first signal and said reference voltage source.

10. A fuel pressure regulation system as defined in claim 5, wherein said control circuit includes an amplifier circuit having an input coupled to said first input of said control circuit and an output coupled to said first input of said first stage.

11. A fuel pressure regulation system as defined in claim 5, wherein said first stage is operable to control the fuel pressure via said fuel pressure control device to maintain the fuel pressure at a fixed proportion to the air pressure.

12. A fuel pressure regulation system as defined in claim 5, wherein said control circuit includes a second stage having an input coupled to said output of said first stage and an output coupled to said output of said control circuit, wherein said second stage provides pulse width modulation of said fuel pressure control device using the third signal provided by said first stage.

13. A fuel pressure regulation system as defined in claim 12, wherein said second stage includes a periodic waveform generator.

14. A method of regulating fuel pressure within a fuel rail of an internal combustion engine having an air rail that provides pressurized air for use in atomizing fuel from the fuel rail, the method comprising the steps of:

(a) generating a first signal representative of the air pressure within the air rail, (b) generating a second signal representative of the fuel pressure within the fuel rail, (c) providing a fuel pressure control device, and (d) utilizing the fuel pressure control device to adjust the fuel pressure in the fuel rail according to the first and second signals.

15. The method of claim 14, wherein step (d) further comprises providing closed loop control to adjust the fuel pressure in the fuel rail according to the first and second signals.

16. The method of claim 15, wherein step (d) further comprises providing proportional control for adjusting the fuel pressure in the fuel rail.

17. The method of claim 16, wherein step (d) further comprises providing integral control for adjusting the fuel pressure in the fuel rail.

18. The method of claim 15, wherein step (d) further comprises providing a reference voltage representative of a fixed pressure difference between an air rail pressure and a fuel rail pressure, whereby the first signal, second signal, and the reference voltage are used in providing closed loop control.

19. The method of claim 14, further comprising carrying out step (d) using an analog control circuit and fuel pump.

20. The method of claim 14, wherein step (d) further comprises maintaining the fuel pressure within a fuel rail at a fixed pressure relative to the air pressure.

21. A fuel delivery system for use with an internal combustion engine, comprising:

an air source having an outlet, an air pressure sensor having an input in communication with said air source outlet and an output which provides a first signal representative of the air pressure at said air source outlet, a fuel source having an outlet, a fuel delivery pump having an inlet and an outlet, with said inlet being in fluid communication with said fuel source outlet to draw fuel from said fuel source, a high pressure fuel pump having a fluid inlet in fluid communication with said fuel delivery pump outlet, a fluid outlet, and a signal input, a fuel pressure sensor having an input in communication with said high pressure fuel pump fluid outlet and having an output which provides a second signal representative of a fuel pressure at said high pressure fuel pump fluid outlet, an injector unit having a first inlet in communication with said air source outlet, a second inlet in communication with said high pressure fuel pump fluid outlet, and an outlet in communication with the combustion chamber of an internal combustion engine, and a control circuit having a first input which is coupled to said air pressure sensor output to thereby receive said first signal, a second input which is coupled to said fuel pressure sensor output to thereby receive said second signal, and an output which is coupled to said high pressure fuel pump signal input to thereby transmit a third signal which is determined using said first and second signals, wherein said high pressure fuel pump adjusts the fuel pressure at said high pressure fuel pump fluid outlet in accordance with said third signal.

* * * * *